US012404088B2

(12) United States Patent
Myers et al.

(10) Patent No.: US 12,404,088 B2
(45) Date of Patent: Sep. 2, 2025

(54) FORMED-FIBER BOX FOR PRODUCE

(71) Applicant: Bull Trout LLC, Seattle, WA (US)

(72) Inventors: Drew Myers, Seattle, WA (US); Aaron Blake, Leavenworth, WA (US)

(73) Assignee: BULL TROUT LLC, Seattle, WA (US)

( * ) Notice: Subject to any disclaimer, the term of this patent is extended or adjusted under 35 U.S.C. 154(b) by 0 days.

(21) Appl. No.: 18/754,834

(22) Filed: Jun. 26, 2024

(65) Prior Publication Data

US 2025/0026527 A1 Jan. 23, 2025

Related U.S. Application Data

(60) Provisional application No. 63/513,964, filed on Jul. 17, 2023.

(51) Int. Cl.

| | |
|---|---|
| ***B65D 85/34*** | (2006.01) |
| ***B65D 25/54*** | (2006.01) |
| ***B65D 43/16*** | (2006.01) |

(52) U.S. Cl.

CPC ..... *B65D 85/34* (2013.01); *B65D 25/54* (2013.01); *B65D 43/162* (2013.01)

(58) Field of Classification Search

None

See application file for complete search history.

(56) References Cited

U.S. PATENT DOCUMENTS 5,405,009 A * 4/1995 Hackenbracht ..... B65D 43/162 220/4.23

7,665,608 B2 * 2/2010 Buckley ..... B65D 85/32 206/521.1

(Continued)

FOREIGN PATENT DOCUMENTS

EP 2345594 A1 * 7/2011 ..... B65D 25/2802

*Primary Examiner* — Mollie Impink

(74) *Attorney, Agent, or Firm* — MERCHANT & GOULD P.C.

(57) ABSTRACT

A formed fiber box for produce includes a base including a major axis and six spherical receivers arranged in a two-by-three grid. The three spherical receivers are disposed on each side of the major axis. Each of the spherical receivers includes an inner diameter of about 90 mm. A cylindrical cup extends from the bottom of each of the spherical receivers. A major axis wall is disposed along the major axis and defined by a first height H1 from a bottom surface of one of the cylindrical cups. A pair of transverse separation walls is disposed substantially orthogonal to the major axis. Each of the pair of transverse separation walls are defined by a second height H2 from the bottom surface of one of the cylindrical cups. The second height H2 is less than the first height H1. Each of the pair of transverse separation walls are disposed between adjacent pairs of spherical receivers. An intersection pillar is disposed at an intersection of the major axis wall and each of the transverse separation walls. Each of the intersection pillars defines a third height H3 from the bottom surface of one of the cylindrical cups. The third height H3 is greater than the first height H1. A lid including a parapet wall substantially surrounds a roof plane. A living hinge secures the base to the lid. The living hinge is disposed in a direction substantially parallel to and on a first side of the major axis.

10 Claims, 12 Drawing Sheets

(56) References Cited

U.S. PATENT DOCUMENTS

| | | | | |
|---|---|---|---|---|
| D791,616 | S * | 7/2017 | Mühlemann | D9/757 |
| 2025/0027276 | A1* | 1/2025 | Myers | B65D 1/36 |

* cited by examiner

FORMED-FIBER BOX FOR PRODUCE

CROSS REFERENCE TO RELATED APPLICATIONS

This application claims the benefit of U.S. Provisional Application No. 63/513,964, filed Jul. 17, 2023, which application is hereby incorporated by reference.

INTRODUCTION

Various types of containers are used for the shipment of agricultural products such as fruits and vegetables. Materials utilized in the manufacture thereof include, for example, plastic or formed fiber of various qualities. Regardless of the container utilized, product can often arrive at a store (for further purchase by consumers) bruised or otherwise damaged. The containers themselves are often not of a sufficiently robust construction to prevent damage to the fruit under sometimes harsh shipping and handling conditions. Further, even product that is seemingly pristine at the time of sale to consumers may by damaged on the trip home, leading to a poor overall impression of the product.

Formed Fiber Box for Produce

In one aspect, the technology relates to a formed fiber box for produce, the box includes: a base including: a major axis; six spherical receivers arranged in a two-by-three grid, wherein three spherical receivers are disposed on each side of the major axis, and wherein each of the spherical receivers includes an inner diameter of about 90 mm; a cylindrical cup extending from the bottom of each of the spherical receivers; a major axis wall disposed along the major axis and defined by a first height H1 from a bottom surface of one of the cylindrical cups; a pair of transverse separation walls disposed substantially orthogonal to the major axis, wherein each of the pair of transverse separation walls are defined by a second height H2 from the bottom surface of one of the cylindrical cups, wherein the second height H2 is less than the first height H1, and wherein each of the pair of transverse separation walls are disposed between adjacent pairs of spherical receivers; an intersection pillar disposed at an intersection of the major axis wall and each of the transverse separation walls, wherein each of the intersection pillars defines a third height H3 from the bottom surface of one of the cylindrical cups, wherein the third height H3 is greater than the first height H1; a lid including a parapet wall substantially surrounding a roof plane; and a living hinge securing the base to the lid, wherein the living hinge is disposed in a direction substantially parallel to and on a first side of the major axis. In an example, the six cylindrical cups define an outer rounded rectangular footprint having a footprint width FW and a footprint length FL, and wherein the roof plane includes a roof plane width RW greater than the footprint width FW and a roof plane length RL greater than the footprint length FL. In another example, the parapet wall is non-contiguous. In yet another example, the base further includes a pair of end pillars aligned with the pair of intersection pillars along the major axis, wherein each of the pair of end pillars includes the third height. In still another example, each of the six cylindrical cups is aligned with a center of an associated one of the six spherical receivers.

In another example of the above aspect, an axial separation distance between an adjacent pair of spherical receivers along the major axis is substantially the same as a transverse separation distance between an adjacent pair of spherical receivers along one of the pair of transverse separation walls. In an example, the base further includes a pair of buttresses disposed on a second side of the major axis, wherein each buttress of the pair of buttresses is aligned with one of the pair of transverse separation walls. In another example, the box further includes a living tab extending from the base on a second side of the major axis, wherein the living tab is positionable in a first position and a second position. In yet another example, the living tab includes a pair of integral springs substantially aligned and in contact with the pair of buttresses when the living tab is in the first position. In still another example, contact between the pair of integral springs and the pair of buttresses biases the living tab towards the second position.

BRIEF DESCRIPTION OF THE DRAWINGS

The following drawing figures, which form a part of this application, are illustrative of described technology and are not meant to limit the scope of the disclosure as claimed in any manner, which scope shall be based on the claims appended hereto.

DETAILED DESCRIPTION

Figure 1A:
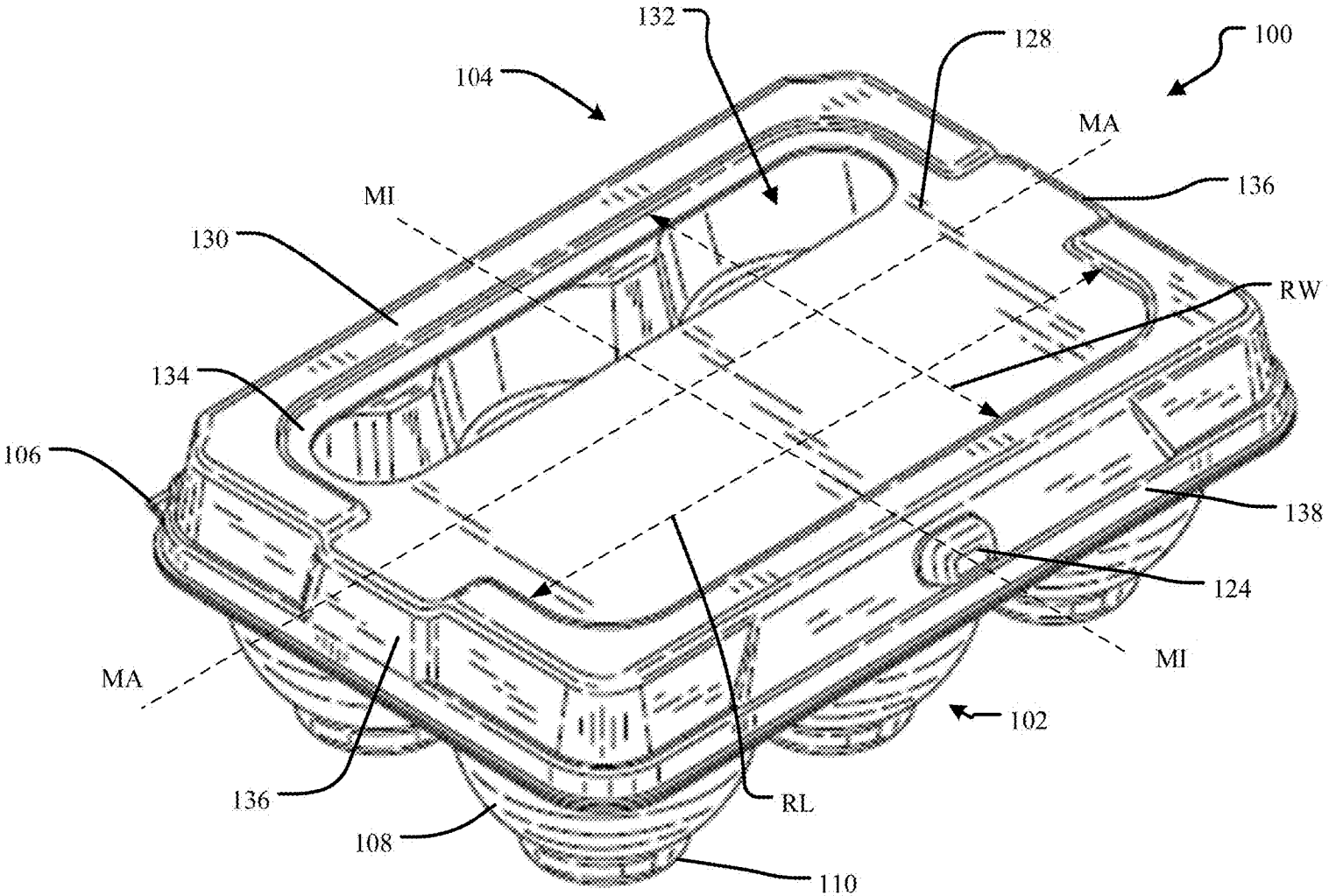
FIGS. 1A and 1B depicts top and bottom perspective views, respectively, of a container for produce in a closed condition.
Figure 1B:
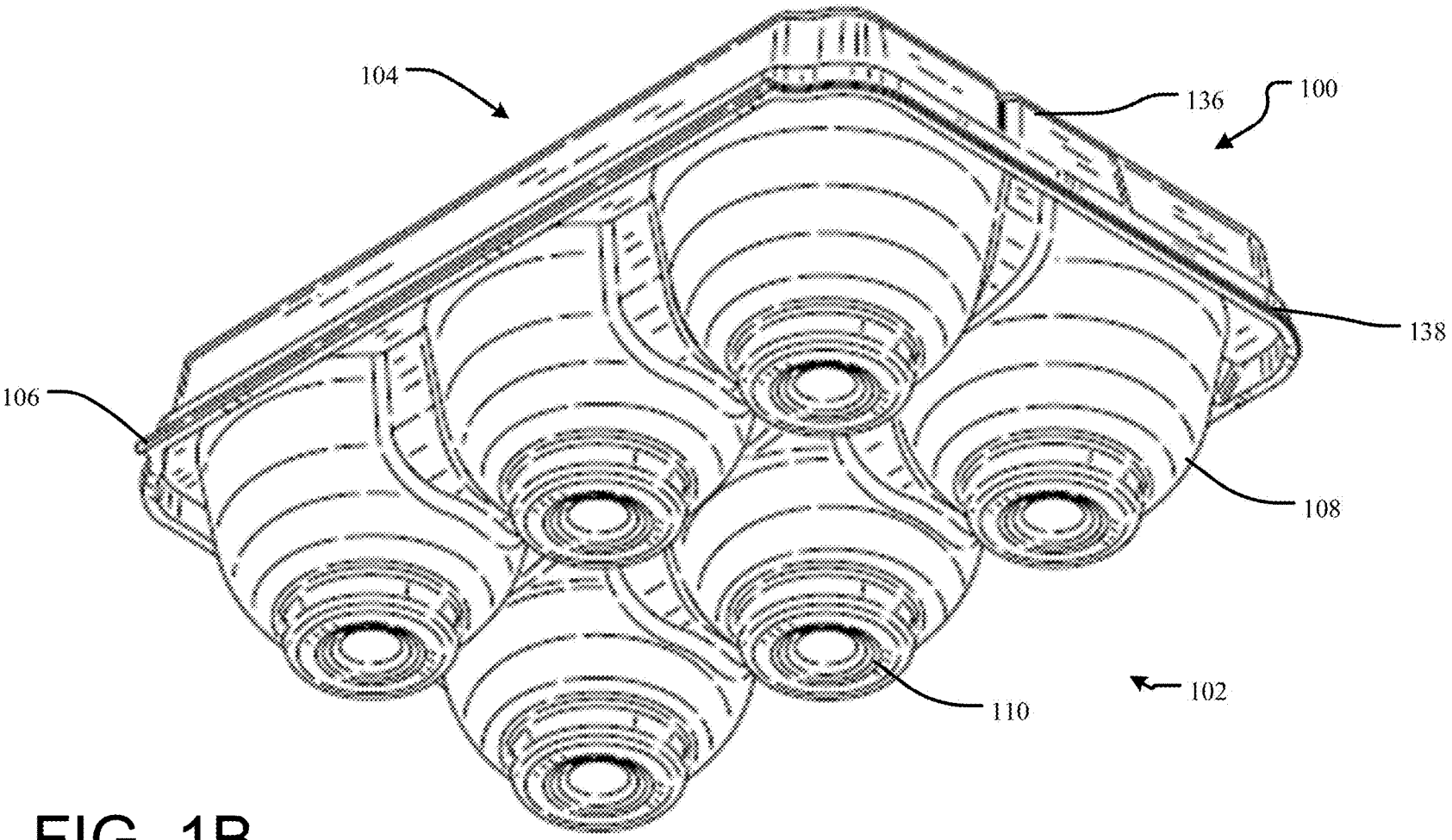
Figure 1C:
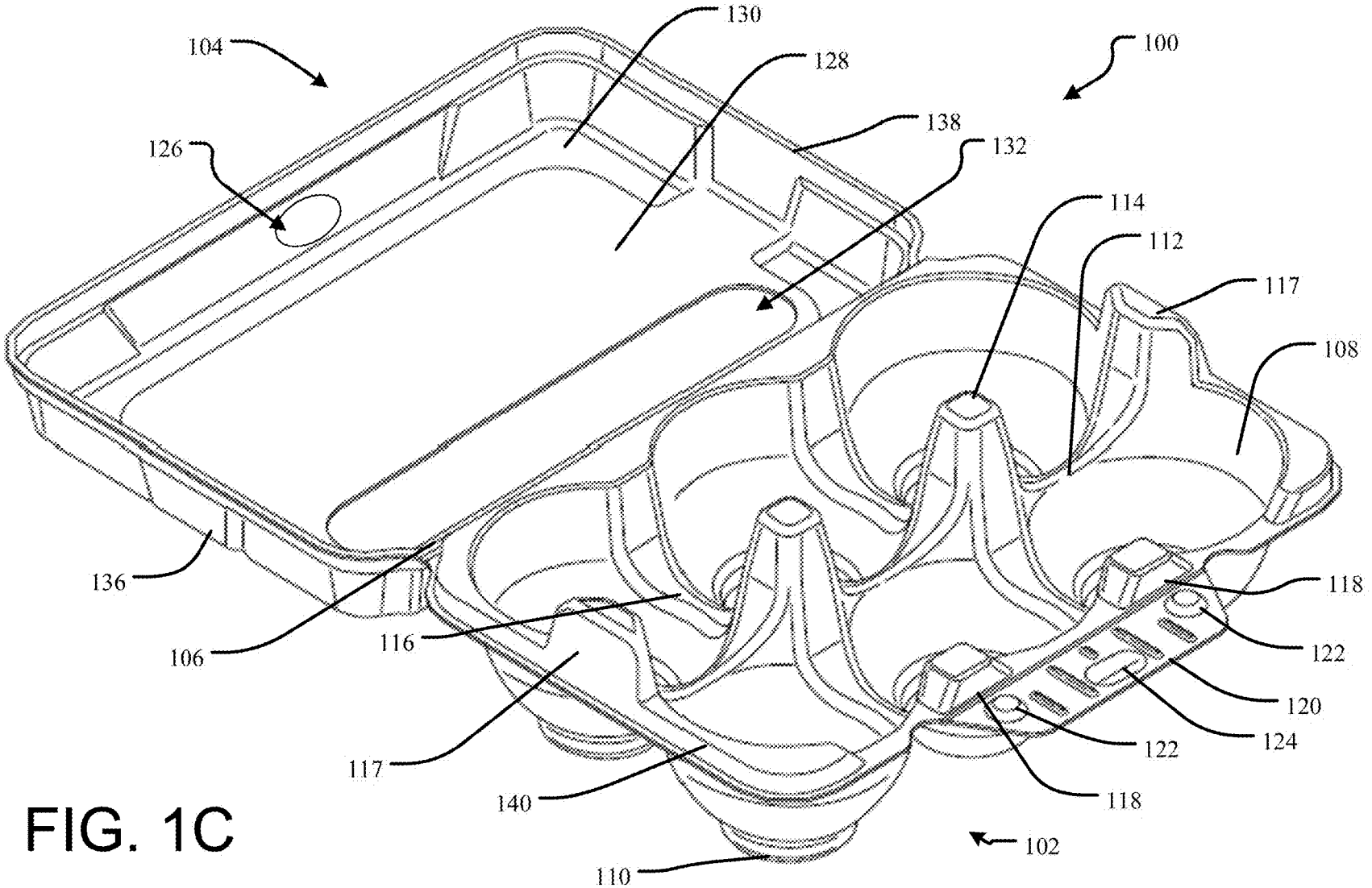
FIG. 1C depicts a top perspective view of a container for produce in an open condition.
Figure 2A:
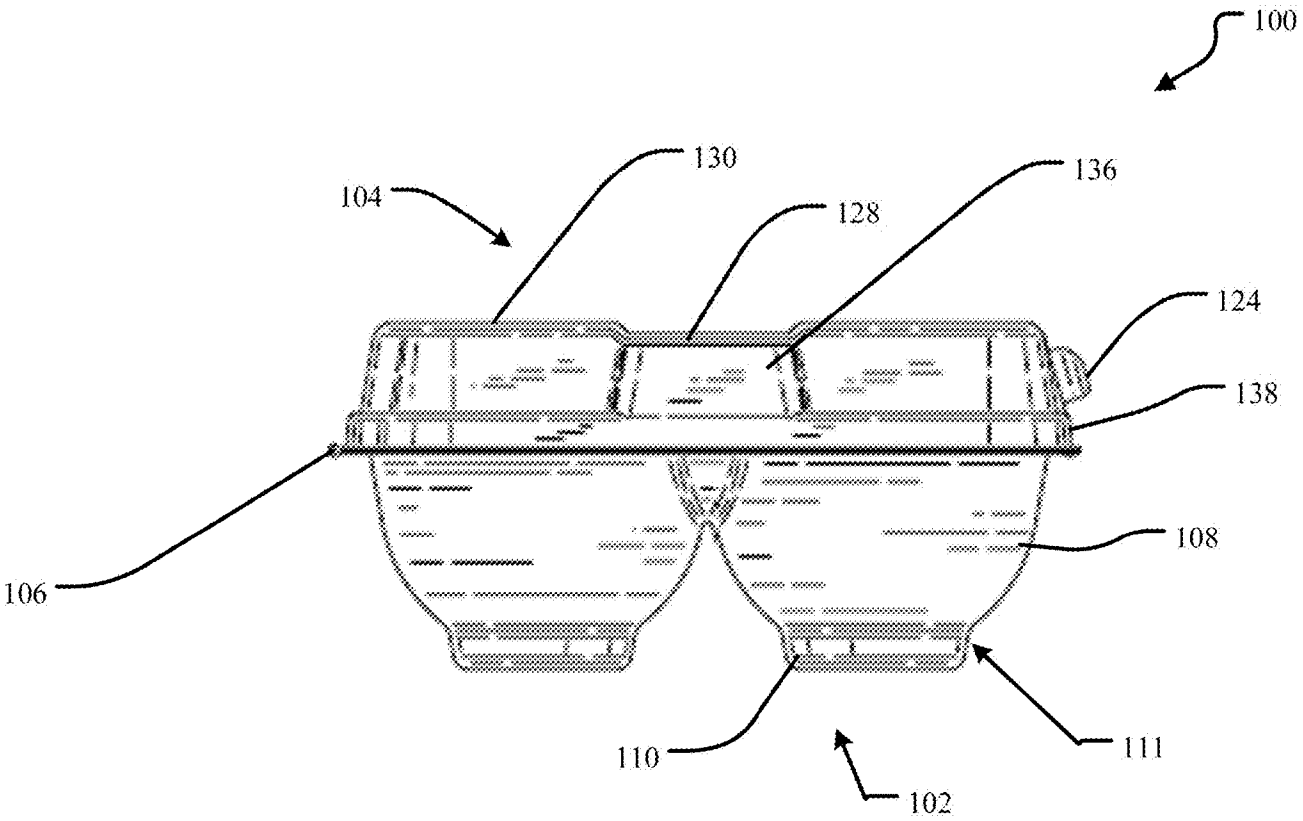
FIGS. 2A and 2B depict side views of a container for produce in a closed condition and an open condition, respectively.
Figure 2B:
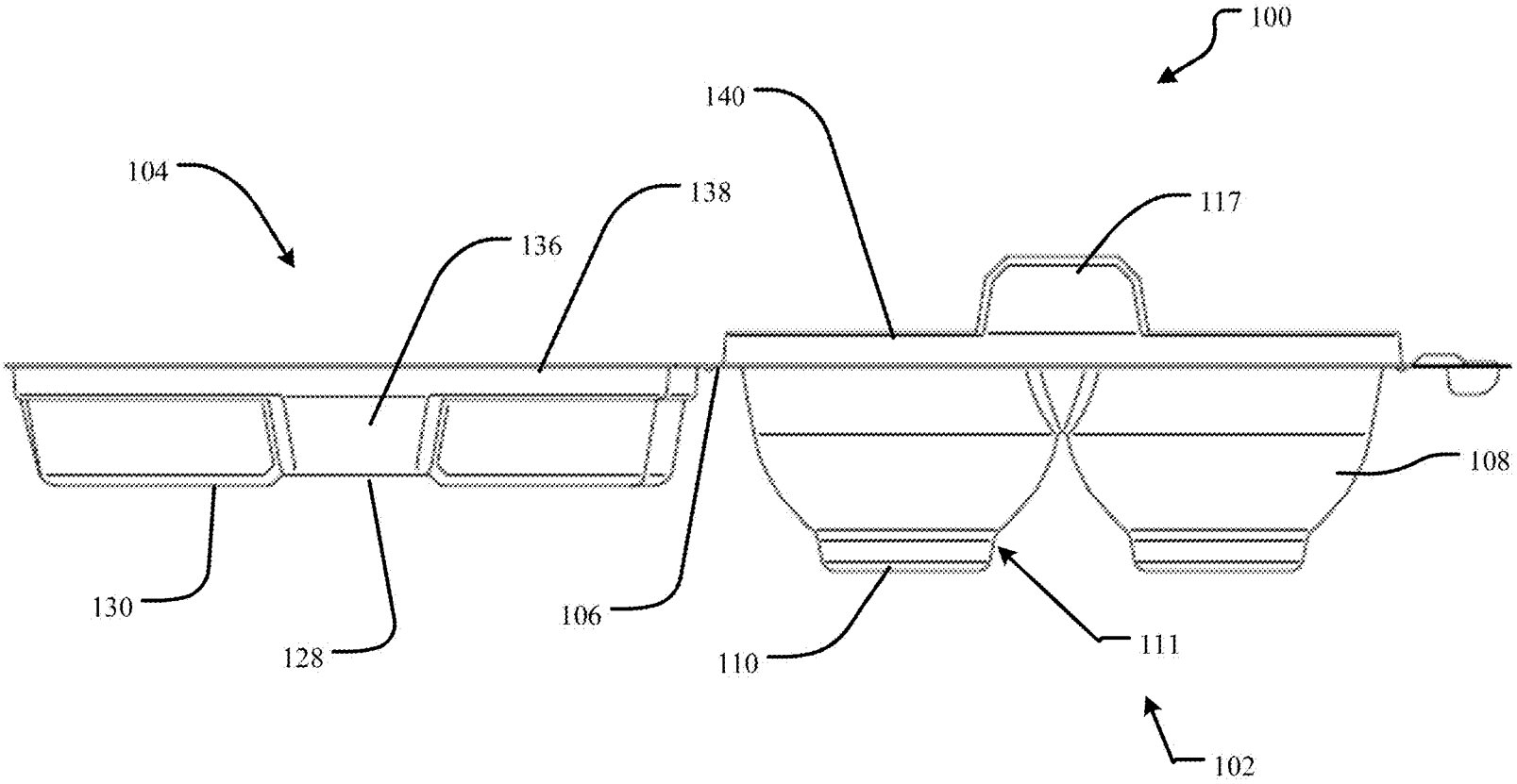
Figure 2C:
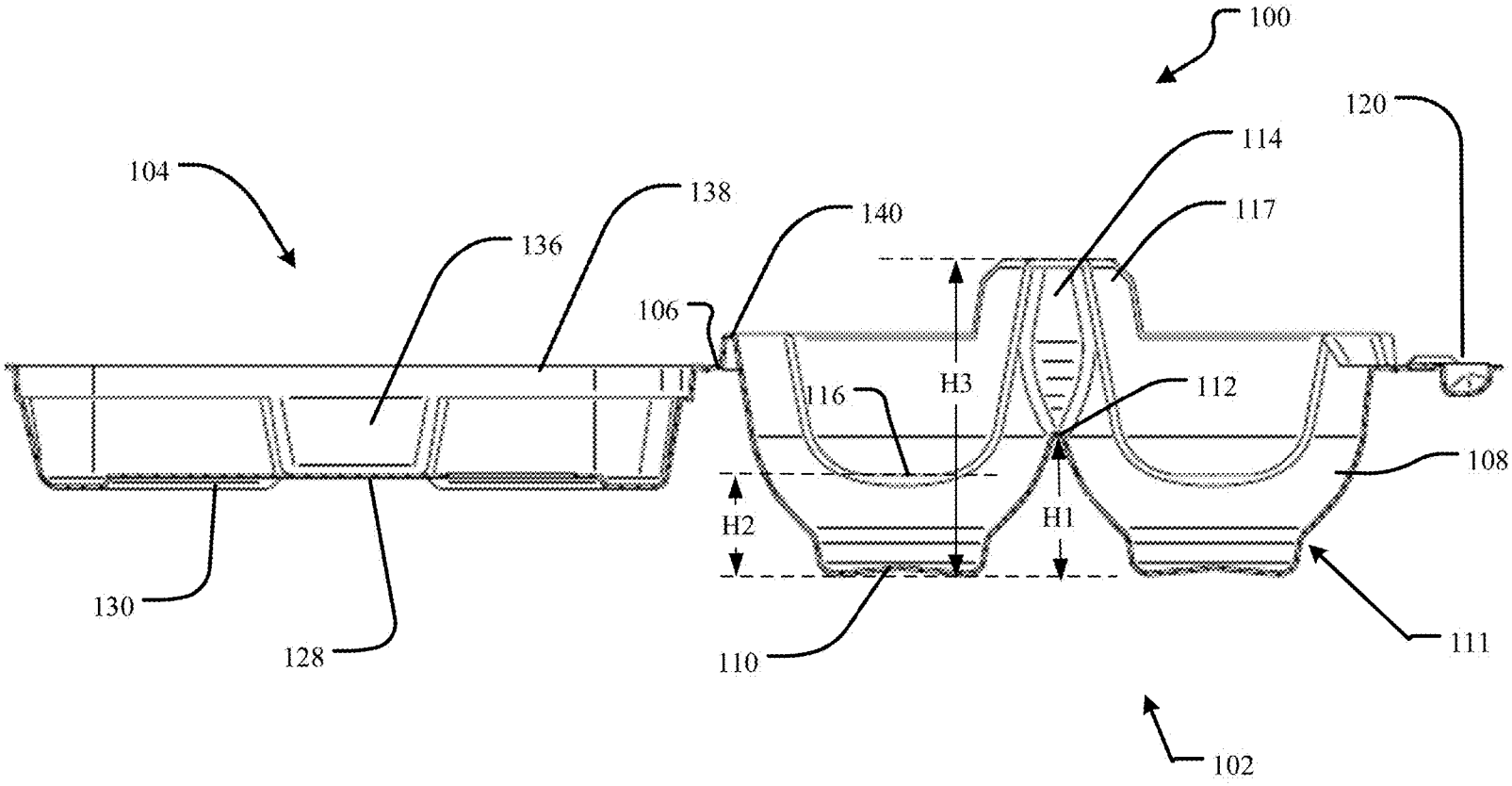
FIG. 2C depicts a sectional view of a container for produce in an open condition.
Figure 3A:
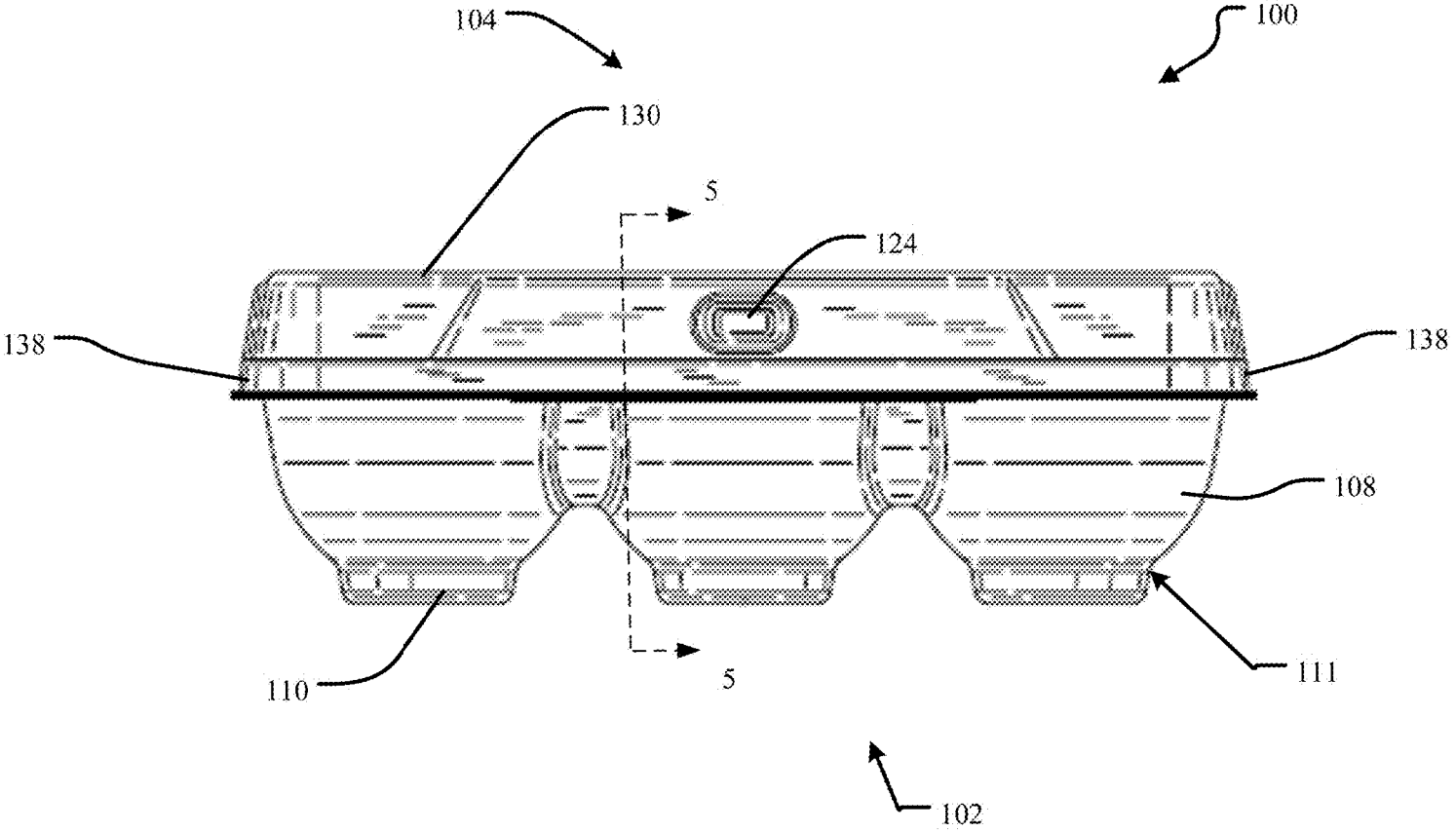
FIGS. 3A and 3B depict a front view of a container for produce in a closed condition and an open condition, respectively.
Figure 3B:
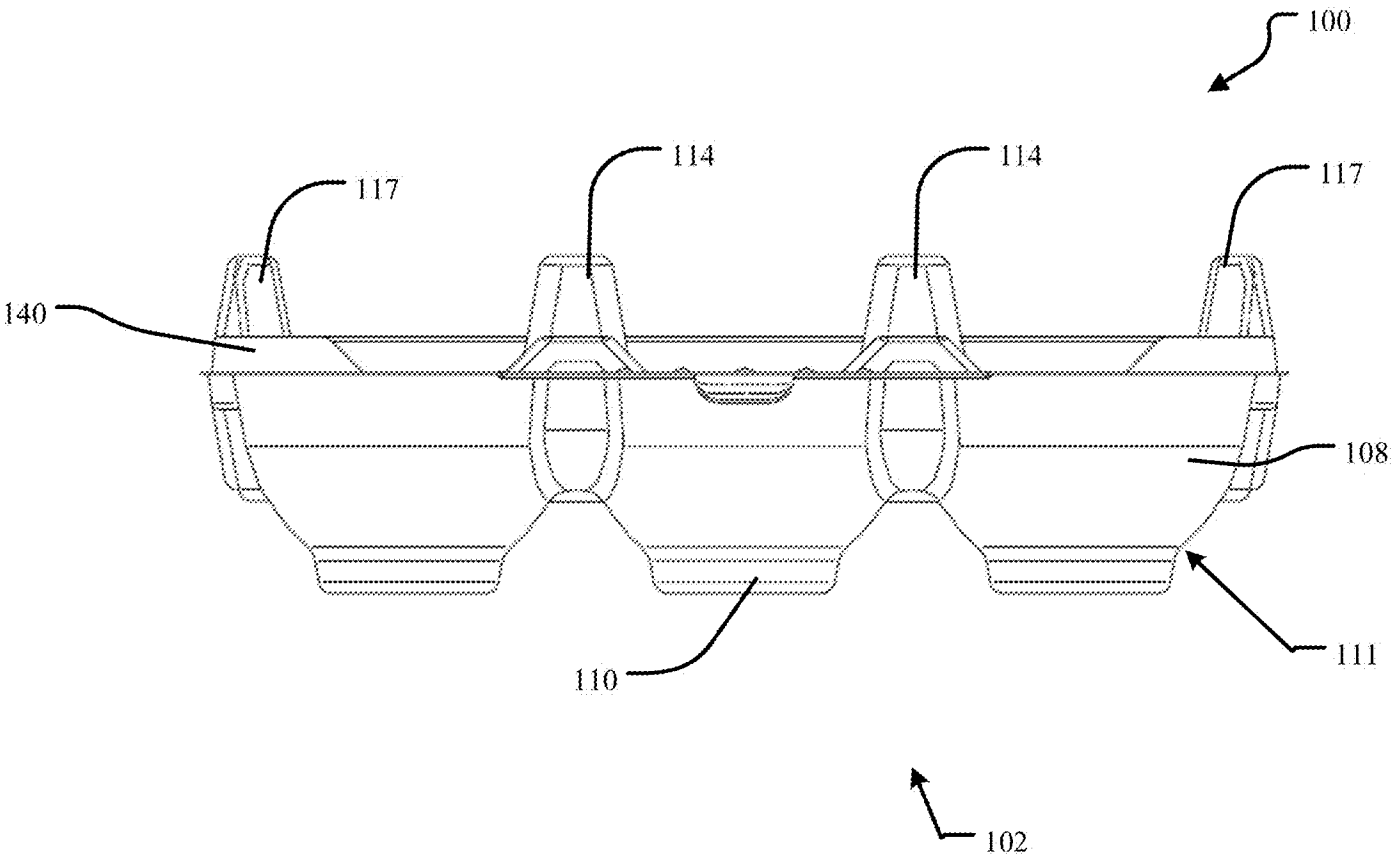
Figure 3C:
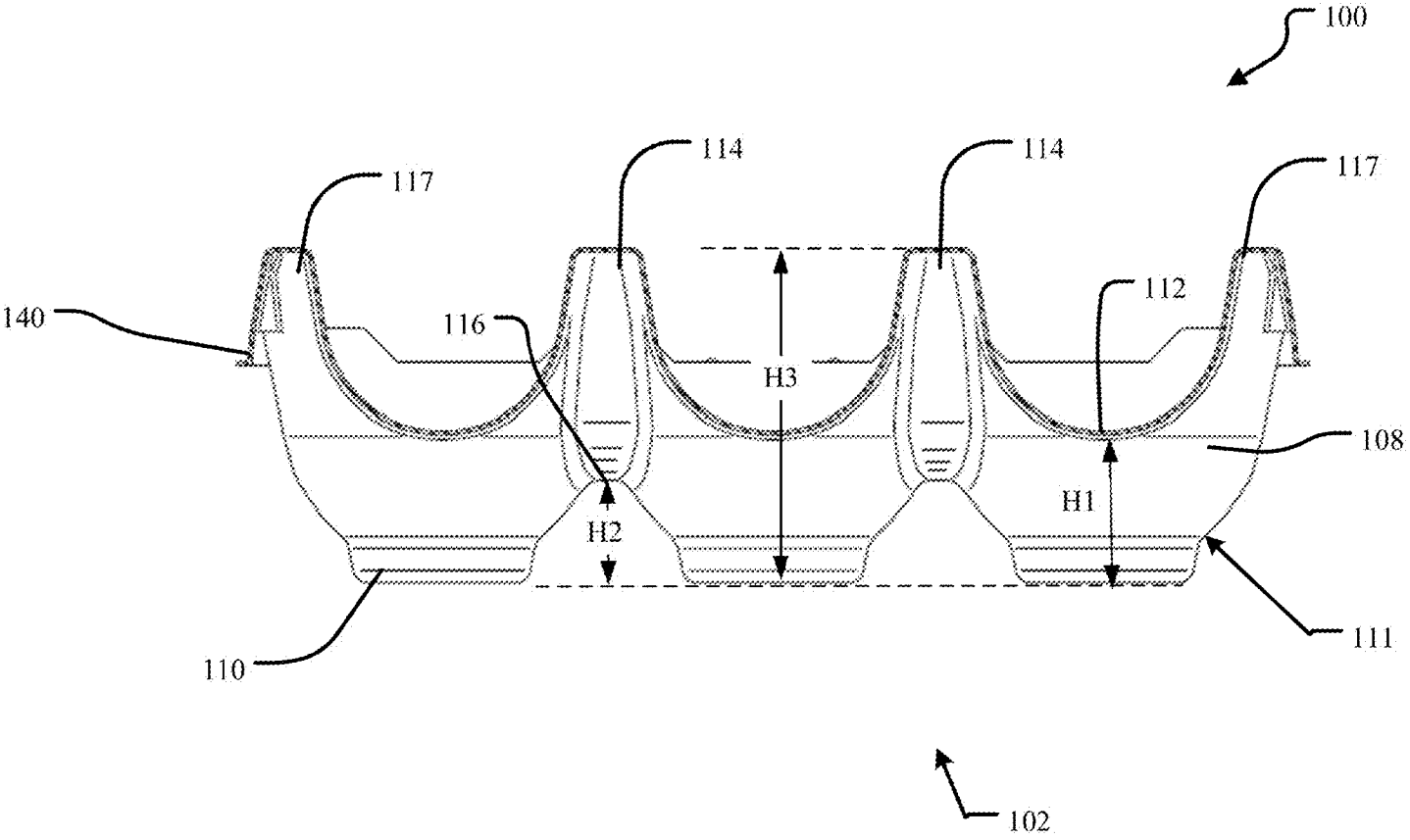
FIG. 3C depicts a sectional view of a container for produce in an open condition.
Figure 4A:
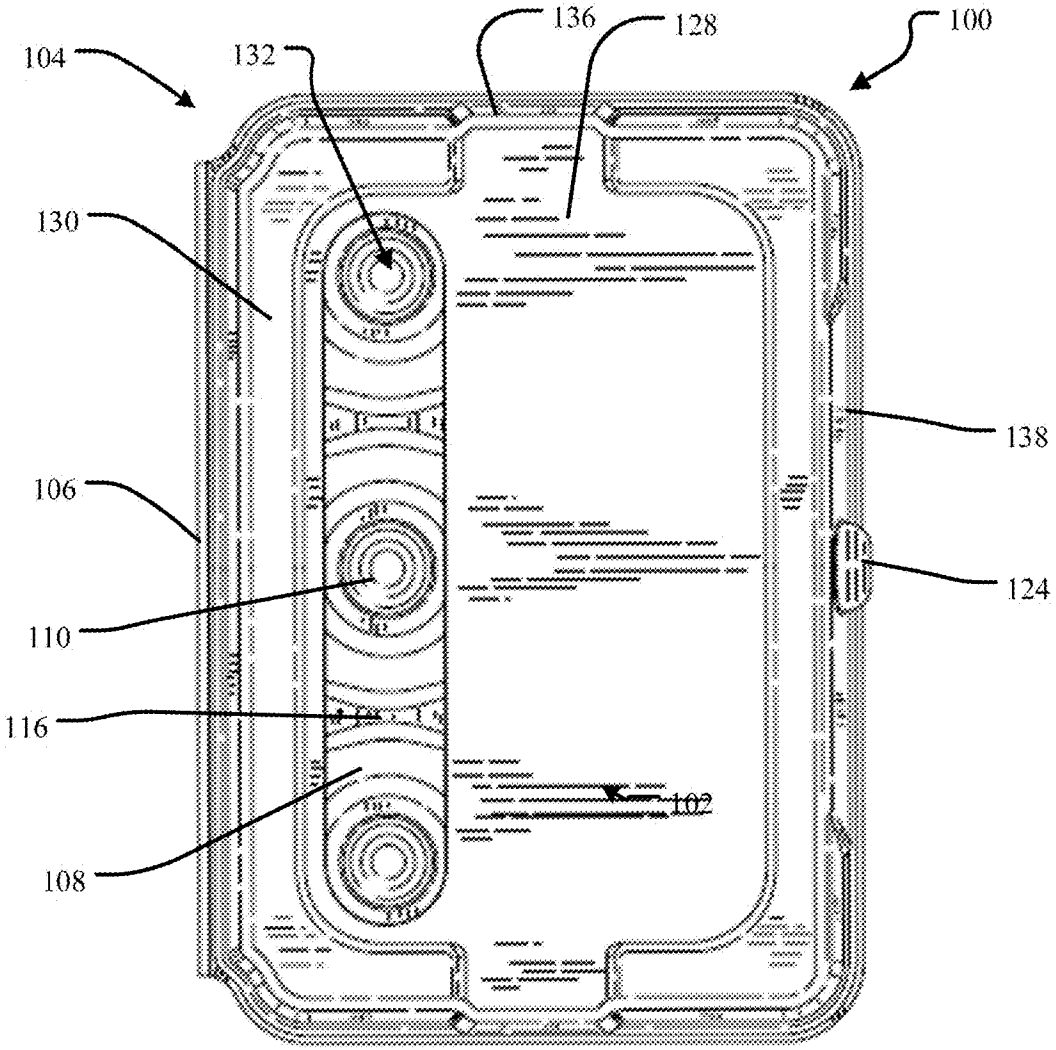
FIGS. 4A and 4B depict top views of a container for produce in a closed condition and an open condition, respectively.
Figure 4B:
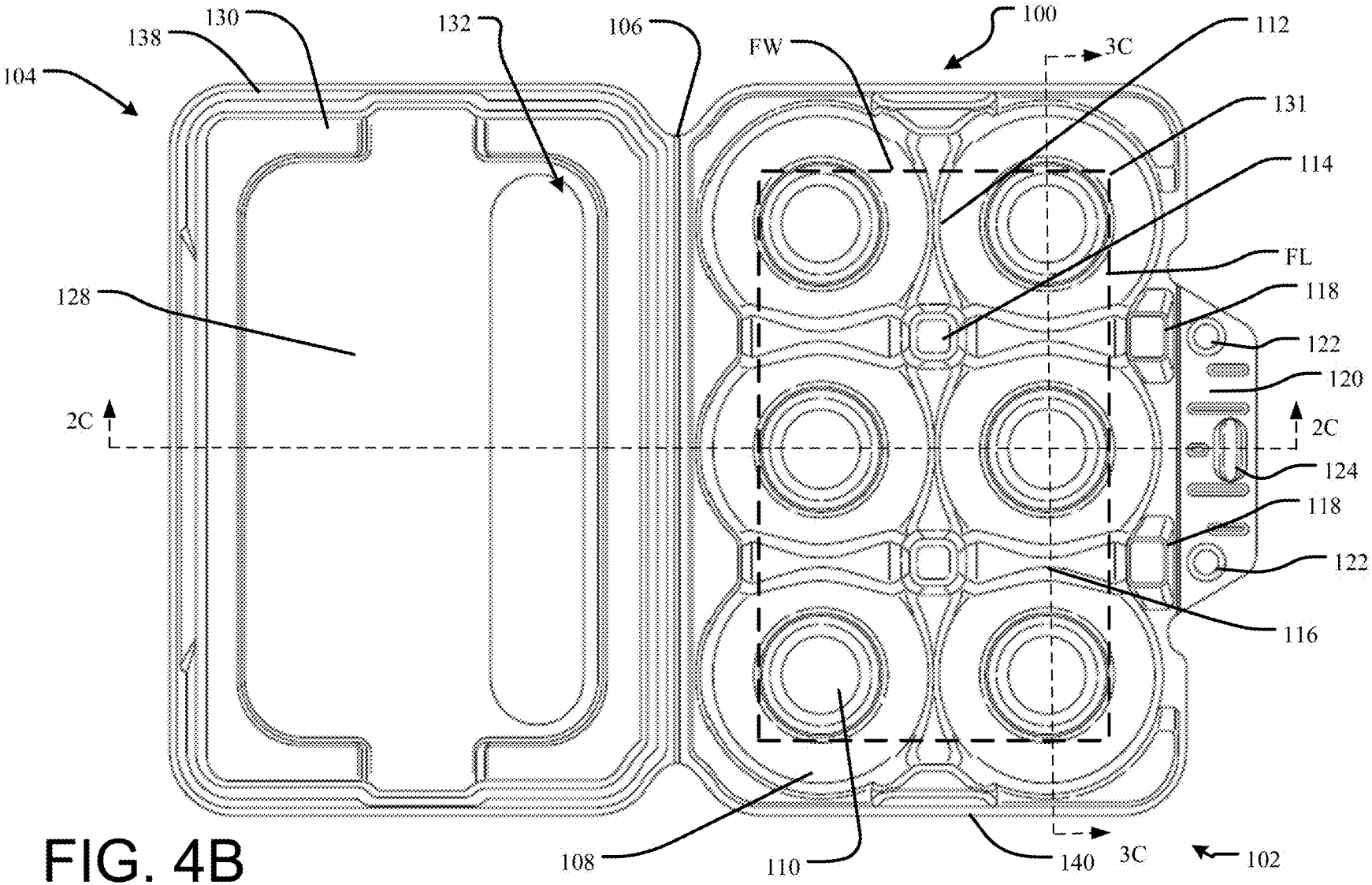

FIGS. 1A-4B depict various views of a container for produce. The figures are described concurrently and not every feature described herein is necessarily depicted and/or labeled in every figure. Containers utilizing the features described herein are particularly well-suited to the transport and storage of various types of apples, as described, but other produce, such as pears, Asian apple pears, citrus fruits, tomatoes, eggplants, etc., may also benefit greatly from being packed in containers having the features described herein.

With regard to apples, specifically, the containers described herein include one or more features that reduce or prevent bruising or other damage thereto. Such bruising or damage may occur due to sudden forceful impact or consistent applied pressure between adjacent apples, or between an apple and the container itself. The containers described herein, as well as structural features thereof, are designed to reduce or eliminate damage to apples of varying sizes, for example, size #64, size #72, and size #80, thus enabling multiple sizes of apples to be protected within a single container, or a single container to protect apples of the same size. Further, and as described in more detail herein, the receivers in the container are formed from both a primary spherical volume and a cylindrical cup extending therefrom, thus enabling the containers described herein to safely accommodate both spherical and teardrop-shaped apples. Again, like the variety of sizes of apples that may be accommodated in a single container, the containers described herein may accommodate a single variety or multiple varieties of apples.

In one particular example, the container is designed to accommodate size #72 apples, which have an approximate weight of about 9.3 oz per apple. Different apple varieties have different characteristic shapes, with Honey Crisps being considered by some as the most spherical, and Galas being considered the most teardrop-shaped. For nearly all varieties, it has been determined that a clearance sphere (within each receiver, described below), should be about 90 mm in diameter. Extensive research has been performed to determine that, across a large sample of apples of multiple varieties, all size #72 apples should be able to fit in a container that provides a 90 mm diameter spherical void per apple. It is important to recognize that apple shapes vary widely, and that not all apples sit vertically during shipment; rather, apples will rotate, lean, or tip to find the orientation that best matches an individual apple's shape to the receiver curvature.

The material used for the containers described herein may be any typically used for shipping or packaging containers, such as various types of molded or formed plastics, light-weight metals, or formed fiber materials such as Type-1, Type-2, Type-3, or Type-4 molded fiber, though Type-3 molded fiber is particularly desirable in that it displays the desired dimensional tolerance and manufacturability advantages. The use of molded fiber in the manufacturing of the containers enables use of recycled, composted, waste, or virgin precursor material in the containers, which may ultimately be recycled or composted themselves after use. Systems and methods for various types of thermoforming of molded fibers are known in the art.

Turning now to the FIGS. 1A-4B, a container 100 utilized in the context of apple packing and shipment will be described, for clarity. The container 100 may be formed from a unitary body defined by a major axis MA (substantially parallel to the longer dimension of the container 100, and at the mid-point of the shorter dimension) and a minor axis MI (substantially parallel to the shorter dimension of the container 100, and at the mid-point of the longer dimension). The container 100 includes a base 102 and a lid 104 joined at a living hinge 106. The living hinge 106 may be perforated so as to enable easy separation of the base 102 from the lid 104, if required or desired. The base 102 defines a plurality of spherical receivers 108, each of which includes, extending from a bottom thereof, a cylindrical cup 110. A center of each receiver 108 is aligned with a center of each corresponding cylindrical cup 110. The cylindrical cup 110 allows non-spherical apples with vertical axes longer than the diameter of the receiver 108 to fit in the container 100. The bottom outer surface of the cylindrical cups 110 also define a bottom-most extent of the container 100, as well as a stacking feature described in further detail below. A chamfer 111 at the interface between the receiver 108 and the cylindrical cup 110 prevents failure of this interface during container stacking, which can cause bruising.

The cylindrical cup 110 also enables receipt of teardrop-shaped apples, without application of excess pressure to the bottom portion of the apple (which may extend into the cup 110). Significant research has been performed to determine how apples are stabilized during transportation. Known transportation containers are referred to as pallets, types of which include so-called "tray packs", "single stack Euros", and "two piece Euros". Within these types of palletization options are placed one or more Keyes traypack inserts, which are generally formed of fiber or cardboard sheets having a predetermined pattern of spherical indentations into which individual apples are received. Multiple traypack inserts may be used to stack layers of apples within a single pallet. The indentations may be circular in outer perimeter shape, spherical in curvature, and about 25 mm deep. It has been determined that a spherical shape on the bottom of cup is important because it prevents apples of differing shapes from rolling, shifting, and/or vibrating during transportation. In general, each apple, regardless of variety (shape), finds its own equilibrium position within the indentation. For example, (more spherical) Honey Crisp apples tend to sit on the traypack inserts right side up, while (teardrop-shaped) Galas tend to rotate about 45 degrees from vertical. Either position is appropriate for stable transportation.

The depth of the receivers 108 in the container 100 described herein due to the adjacent wall described below presents a challenge to this stable positioning for apples. While more spherical apples may sit naturally upright in the spherical receiver 108, teardrop-shaped apples fall to a side. The teardrop shape prevents such apples from settling in the spherical receiver 108, which can result in movement and ultimately bruising. Thus, the cylindrical cup 110 that extends from the bottom of each receiver 108 provides additional space for a portion thereof (typically a bottom portion(s) of the apple that form(s) around the calyx) extend into, thereby improving retention of the apple in position.

The depicted container 100 includes six receivers 108 arranged in a two-by-three grid, with three receivers 108 located on each side of the major axis MA, and the minor axis MI bisecting the middle two of the three paired receivers 108. A major axis wall 112 is disposed substantially along the major axis MA and separates the adjacent receivers 108 on either side of the major axis MA. The major axis wall defines a first height H1 above the bottom-most extent of the container 100 (again defined by an outer bottom surface of the cup 110). The first height H1 is the distance from the bottom surface of the cylindrical cups 110 to the uppermost surface of the lowest point of the major axis wall 112 (e.g., about at the half-way point between two intersection pillars 114). A pair of transverse separation walls 116 separate adjacent ones of the pairs of receivers 108. The transverse separation walls 116 are disposed substantially orthogonal to the major axis wall 112, and are aligned with the two intersection pillars 114. The transverse separation walls 116 define a second height H2 above the bottom-most extent of the container 100. The second height H2 is the distance from the bottom surface of the cylindrical cups 110 to the uppermost surface of the lowest point of the transverse separation wall 116. The second height H2 is less than the first height H1. The difference between the first height H1 and second height H2 allows for better protection of bruising to the produce when the container 100 is placed on its side (e.g., the side having the living hinge 106), as described below. This higher major axis wall 112 prevents the apples contained therein from contacting each other and potentially bruising. However, walls having too great of a height present difficulty when being separated from the mold on which they are formed (in the case of a container 100 made from molded fiber). Thus, the pair of transverse separation walls have a lower second height H2, so as to more easily separate therefrom. The second height H2 of the transverse separation wall 116, combined with the center-to-center distance between adjacent receivers 108 and cylindrical cups 110, allows elliptical or tear-drop shaped apples to rotate off of the vertical axis and find a natural and well-supported position within the spherical receiver 108, wherein a portion of the apple extends into the cylindrical cup 110. This also allows very long size #64 apples to settle into a non-vertical position that is critical for preventing these long apples from touching the lid 104. Transverse separation walls 116 having a higher second height H2 may prevent non-spherical apples from rotating to achieve acceptable lid clearance. Further, since the container is far less likely to be stacked on an end thereof (such that the major axis MA is vertical), transverse separation wall between adjacent receivers 108 is not required or necessarily desirable. In examples, however, containers where the first height H1 and the second height H2 are the same are contemplated.

The two intersection pillars 114 each define a third height H3 that is greater than both the first height H1 and the second height H2. The third height H3 also slightly taller than the diameter of the receiver 108. This prevents pressure transfer to the apples contained in the container 100 during stacking of multiple containers, while still keeping the overall container height appropriate to fit in a stack of three in Tray pack palletization, as described in more detail below. The two intersection pillars 114 provide structural support to the lid 104, for example, when multiple containers 100 are stacked on top of each other. Further, a pair of end pillars 117 provide support to the lid 104 at the ends thereof. In general, the end pillars 117 may be the same third height H3 of the intersection pillars 114. A pair of buttresses 118 is disposed along a long edge of the base 102, on a side opposite the living hinge 106. The buttresses 118 engage with a living tab 120, namely at a mating pair of integral springs 122 thereon. The springs 122 are projections integrally formed with and projecting rearwardly from the living tab 120. The living tab 120 also includes a projection 124 integrally formed with and projecting forwardly from the living tab 120. The projection 124 is configured to releasably project into an opening 126 defined by the lid 104, so as to lock the lid 104 to the base 102.

The lid 104 is generally tapered in overall shape to release easily from a forming mold during manufacture, but this shape also provides stiffness to the container 100 when in a closed configuration. The lid 104 includes a centrally-disposed roof plane 128 at least partially surrounded by a parapet wall 130. In the depicted configuration, the parapet wall 130 is non-contiguous in that it does not completely surround the roof plane 128, but a fully-surrounded roof plane 128 is also contemplated. The roof plane 128 has a roof plane width RW and a roof plane length RL and is characterized by rounded corners. Relevant to a stacking function, the plurality of cylindrical cups 110 define a footprint 131 having a footprint width FW and a footprint length FL. In examples, the footprint 131 is rectangular and defined by rounded corners. The dimensions RW and RL are slightly larger than the corresponding footprint dimensions. More specifically, the footprint width FW is slightly less than the roof plane width RW, and the footprint length FL is slightly less than the roof plane length RL. This enables the plurality of cylindrical cups 110 to rest on the roof plane 128, while the parapet wall 130 prevents the cylindrical cups 110 from sliding off of the sides thereof. This enables a plurality of containers 100 to be easily stacked and moved, effectively locking an upper container in place, relative to a lower container.

The roof plane 128 may also define a window 132 that makes the produce contained within container 100 visible to consumers. The window 132 may be comprised of a reach-through opening, a translucent sheet, or a transparent sheet such as plastic. The window 132 may be separated from the parapet wall 130 by a ledge 134 of a width sufficient to enable support of the cylindrical cups 110 placed thereon, thus preventing the cylindrical cups 110 from falling into the open window 132. Further structural features of the lid 104 enable robust engagement with the base 102. For example, pillar projections 136 engage with the end pillars 117 projecting upward from the base 102 when the container 100 is closed. Similarly, when closed, a lid rim 138 engages with a base rim 140. Both the lid rim 138 and base rim 140 may extend around the entire perimeter of the lid 104 and base 102, respectively. In other examples, the rims 138, 140 may extend around the only portions of the perimeters thereof.

Figure 5:
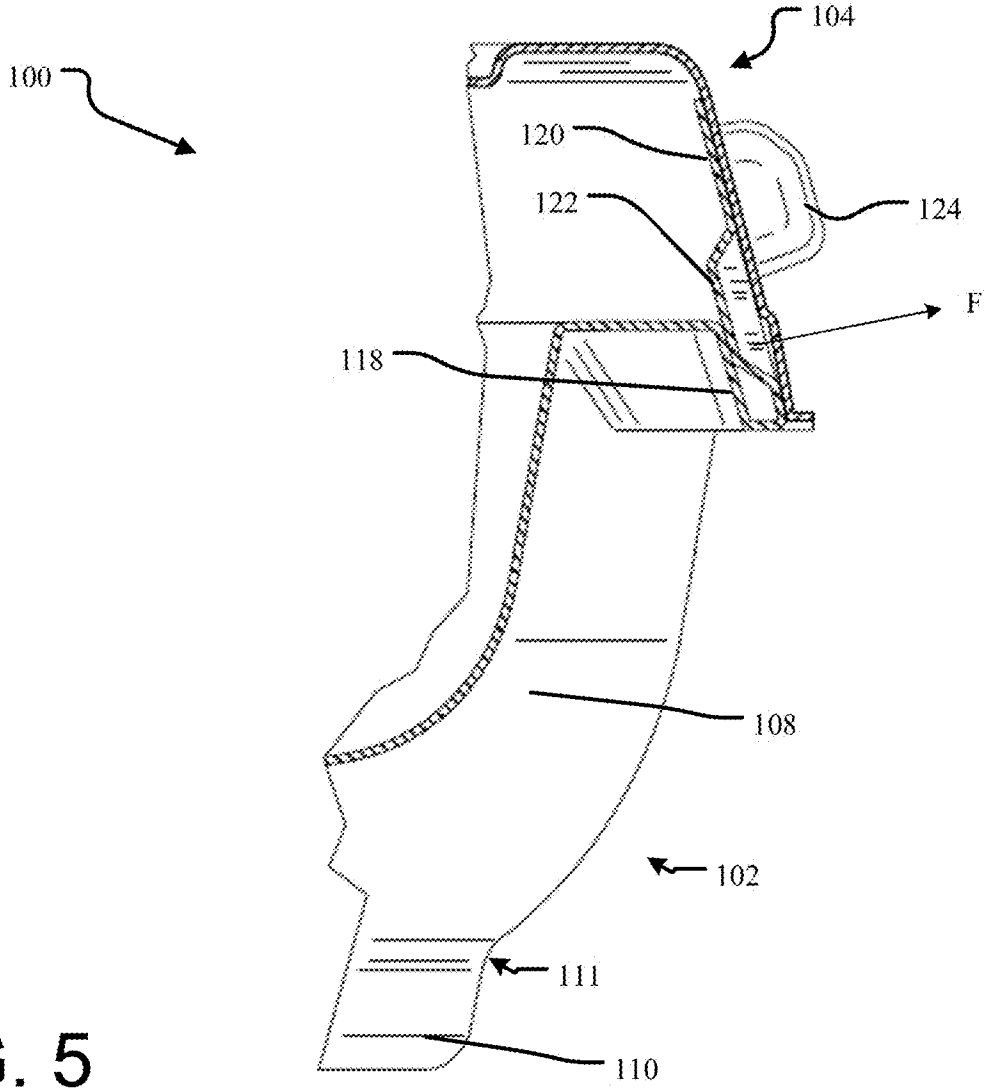
FIG. 5 depicts an enlarged sectional view of a locking tab portion of a container for produce in a closed position.

FIG. 5 depicts an enlarged sectional view of a locking tab 120 portion of a container 100 for produce. As depicted, the locking tab 120 is in the first position, with the projection 124 projecting through the opening 126 in the lid 104. Contact between the buttress 118 and the integral spring 122 of the tab 120 generates a force F to project the tab 120 forward towards a second position. This positively locks the projection 124 within the opening 126, which helps prevent inadvertent release of the locking tab 120.

The dimensions of the various features of the container 100 may be as required or desired for a particular application or as needed to ship a particular product. For a desired application relevant to apples, for example, for the container to safely protect and ship size #64, size #72, and size #80 apples, spherical receivers 108 having nominal inner diameters of about 87 mm, 88 mm, 90 mm, 92 mm, and 93 mm are contemplated. The center-to-center distance between each adjacent receiver may be about 90 mm, 91 mm, 92 mm, 93 mm, and 94 mm. In other examples, center-to center distances may be about 91.95 mm, 92.05 mm, 92.08 mm, 92.11 mm, or 92.21 mm. First height H1 may be about 41 mm, 41.5 mm, 42 mm, 42.5 mm, or 43 mm. In other examples, first height H1 may be about 42.15 mm, 42.16 mm, 42.17 mm, 42.18 mm, 42.19 mm, 42.20 mm, 42.21 mm, 42.22 mm, 42.23 mm, 42.24 mm, and 42.25 mm. Second height H2 may be about 27 mm, 28 mm, 28.5 mm, 29 mm, 29.5 mm, 30 mm, and 31 mm. In particular examples, second height H2 may be about 29.37 mm, 29.38 mm, 29.39 mm, 29.40 mm, or 29.41 mm. Third height H3 may be about 91 mm, 92 mm, or 93 mm. In other examples, third height H3 may be about 92.05 mm, 92.10 mm, 92.15 mm, or 92.20 mm. Other relevant dimensions may include roof plane width RW of about 144 mm. Roof plane length RL may be about 235 mm. As such, the footprint width FW and footprint length are slightly less, so as to fit within the roof plane dimensions. A ledge 134 width of about 4 mm, 5 mm, 6 mm, or 7 mm is also contemplated to adequately support the portions of the cylindrical cups 110 adjacent the window 132.

Overall dimensions of the closed container 100 may be about 298 mm L×206 mm W×108 mm H, based on at least 90 mm diameter spherical receivers 108. These dimensions enable the containers 100 to be palletized in a wide variety of palletization options currently used in the industry. As noted above, palletization types include so-called tray packs, single stack Euros, and two piece Euros. Tray packs have internal dimensions of about 19.25" L×12" W×11.5" H (488.95 mm L×308.8 mm W×292.1 mm H). Thus, in a single tray pack, seven containers may be stacked in two stacks of three containers each, with the seventh container being placed vertically, resting on the living hinge 106. Single stack Euros have internal dimensions of about 23.5" L×15.75" w×7" H (596.9 mm L×400.05 mm W×177.8 mm H). Thus, in a single stack euro, four containers may be arranged horizontally in a single layer on the bottom of the single stack Euro pallet. Two piece Euros have internal dimensions of about 23.5" L×15.75" w×10.5" H (596.9 mm L×400.05 mm W×266.7 mm H). Thus, in a two piece euro, eight containers may be arranged horizontally in two stacked layers of four containers each. Note that the corrugated palletization boxes, regardless of type, are very strong and designed to take the stress off of their contents when stacked.

It is to be understood that this disclosure is not limited to the particular structures, process steps, or materials disclosed herein, but is extended to equivalents thereof as would be recognized by those ordinarily skilled in the relevant arts. It should also be understood that terminology employed herein is used for the purpose of describing particular examples only and is not intended to be limiting. It must be noted that, as used in this specification, the singular forms "a," "an," and "the" include plural referents unless the context clearly dictates otherwise.

It will be clear that the systems and methods described herein are well adapted to attain the ends and advantages mentioned as well as those inherent therein. Those skilled in the art will recognize that the methods and systems within this specification may be implemented in many manners and as such is not to be limited by the foregoing exemplified examples. In this regard, any number of the features of the different examples described herein may be combined into one single example and alternate examples having fewer than or more than all of the features herein described are possible.

While various examples have been described for purposes of this disclosure, various changes and modifications may be made which are well within the scope contemplated by the present disclosure. Numerous other changes may be made which will readily suggest themselves to those skilled in the art and which are encompassed in the spirit of the disclosure.

What is claimed is:

1. A formed fiber box for produce, the box comprising:

a base comprising:

a major axis;

six spherical receivers arranged in a two-by-three grid, wherein three spherical receivers are disposed on each side of the major axis, and wherein each of the spherical receivers comprises an inner diameter of about 90 mm;

a cylindrical cup extending from a bottom surface of each of the spherical receivers;

a major axis wall disposed along the major axis and defined by a first height H1 from the bottom surface of one of the cylindrical cups;

a pair of transverse separation walls disposed substantially orthogonal to the major axis, wherein each of the pair of transverse separation walls are defined by a second height H2 from the bottom surface of one of the cylindrical cups, wherein the second height H2 is less than the first height H1, and wherein each of the pair of transverse separation walls are disposed between adjacent pairs of spherical receivers;

an intersection pillar disposed at an intersection of the major axis wall and each of the pair of transverse separation walls, wherein each of the intersection pillars defines a third height H3 from the bottom surface of one of the cylindrical cups, wherein the third height H3 is greater than the first height H1;

a lid comprising a parapet wall substantially surrounding a roof plane; and a living hinge securing the base to the lid, wherein the living hinge is disposed in a direction substantially parallel to and on a first side of the major axis.

2. The box of claim 1, wherein the six cylindrical cups define an outer rounded rectangular footprint having a footprint width FW and a footprint length FL, and wherein the roof plane comprises a roof plane width RW greater than the footprint width FW and a roof plane length RL greater than the footprint length FL.

3. The box of claim 1, wherein the parapet wall is non-contiguous.

4. The box of claim 1, wherein the base further comprises a pair of end pillars aligned with the pair of intersection pillars along the major axis, wherein each of the pair of end pillars comprise the third height.

5. The box of claim 1, wherein each of the six cylindrical cups is aligned with a center of an associated one of the six spherical receivers.

6. The box of claim 1, wherein an axial separation distance between an adjacent pair of spherical receivers along the major axis is substantially the same as a transverse separation distance between an adjacent pair of spherical receivers along one of the pair of transverse separation walls.

7. The box of claim 1, wherein the base further comprises a pair of buttresses disposed on a second side of the major axis, wherein each buttress of the pair of buttresses is aligned with one of the pair of transverse separation walls.

8. The box of claim 7, further comprising a living tab extending from the base on a second side of the major axis, wherein the living tab is positionable in a first position and a second position.

9. The box of claim 8, wherein the living tab comprises a pair of integral springs substantially aligned and in contact with the pair of buttresses when the living tab is in the first position.

10. The box of claim 9, wherein contact between the pair of integral springs and the pair of buttresses biases the living tab towards the second position.

* * * * *